US005868203A

United States Patent [19]

Cunningham

[11] Patent Number: 5,868,203

[45] Date of Patent: Feb. 9, 1999

[54] APPARATUS AND METHOD FOR SUBSEA CONNECTIONS OF TREES TO SUBSEA WELLHEADS

[75] Inventor: Christopher E. Cunningham, Spring, Tex.

[73] Assignee: FMC Corporation, Chicago, Ill.

[21] Appl. No.: 67,635

[22] Filed: Apr. 28, 1998

Related U.S. Application Data

[60] Provisional application No. 60/044,346 Apr. 29, 1997.

[51] Int. Cl.[6] ..... E21B 33/043

[52] U.S. Cl. ..... 166/344; 166/345; 166/349

[58] Field of Search ..... 166/344, 345, 166/349, 351, 360

[56] References Cited

U.S. PATENT DOCUMENTS

| | | | |
|---|---|---|---|
| 4,036,295 | 7/1977 | Kirkland et al. | 166/342 |
| 4,089,377 | 5/1978 | Chateau . | |
| 4,175,620 | 11/1979 | Nolan et al. | 166/343 |
| 4,770,248 | 9/1988 | Houlgrave et al. | 166/341 |
| 4,823,878 | 4/1989 | Brammer et al. . | |
| 5,129,459 | 7/1992 | Breese et al. | 166/339 |
| 5,503,230 | 4/1996 | Osborne et al. | 166/344 |
| 5,544,707 | 8/1996 | Hopper et al. . | |

OTHER PUBLICATIONS

FMC Brochure Entitled Horizontal Surface Trees.

*Primary Examiner*—Frank S. Tsay
*Attorney, Agent, or Firm*—Bush, Riddle, & Jackson L.L.P.

[57] ABSTRACT

A method and apparatus utilizing a tree running tool (120) for guiding a conventional or horizontal tree (150) for the purpose of connection to a subsea wellhead or wellhead system (110) without the use of guidelines or guide funnels as shown in the embodiment of FIGS. 3 and 4. The horizontal tree (150) has an orientation sleeve (154) projecting downwardly from tree body (150), and the tree running tool (120) has a lower stabbing extension or stinger (100) which extends below the orientation sleeve for guiding and aligning the orientation sleeve (154) into engagement with a high pressure wellhead housing (153) and associated production casing hanger (159) for connection of the tree body (150) to the high pressure wellhead housing (153).

10 Claims, 3 Drawing Sheets

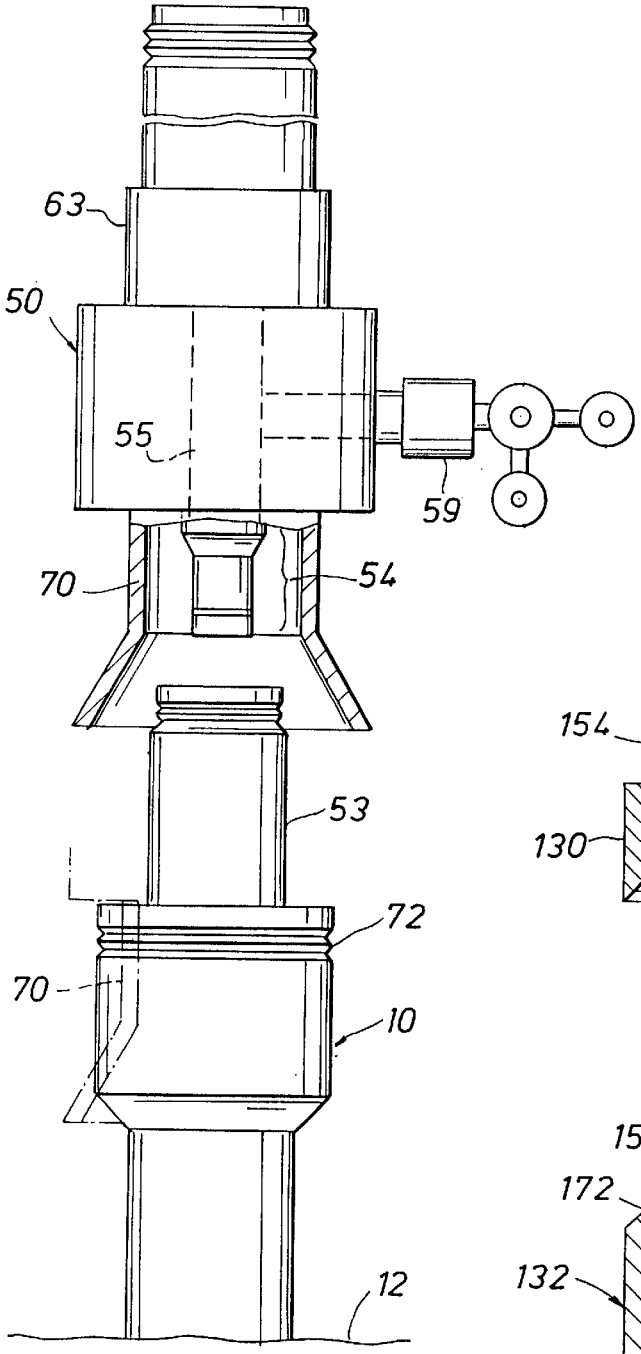
FIG. 2
FIG. 3
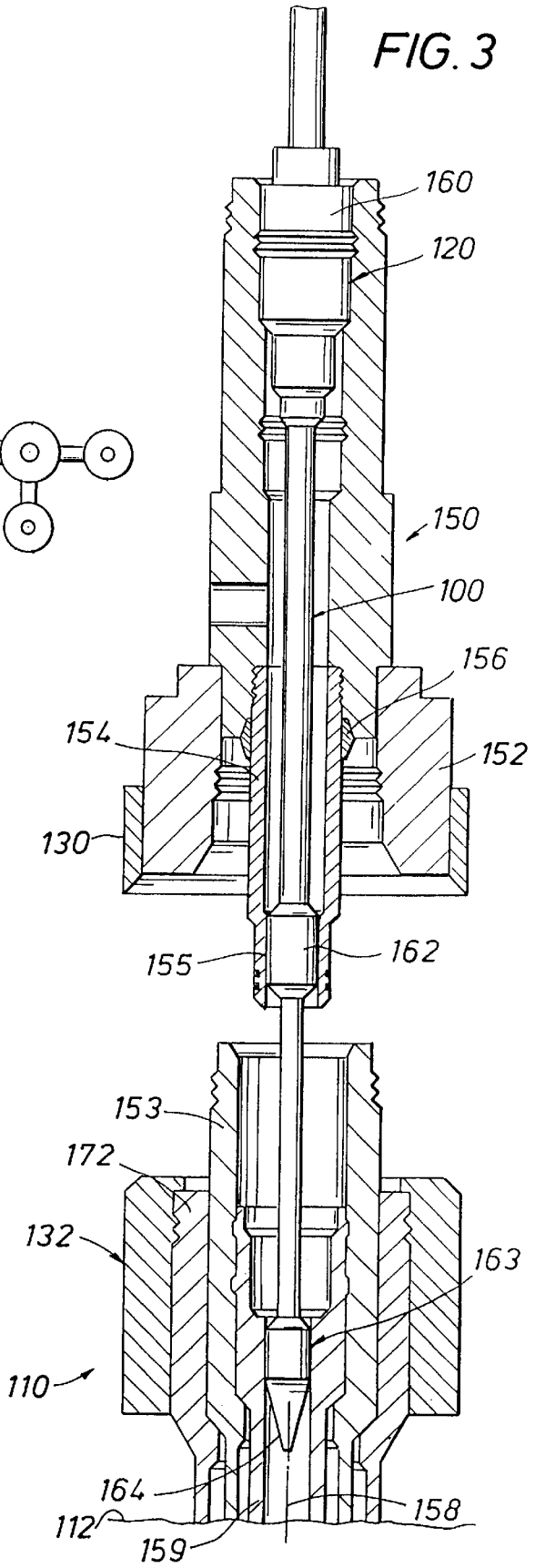

APPARATUS AND METHOD FOR SUBSEA CONNECTIONS OF TREES TO SUBSEA WELLHEADS

REFERENCE TO PROVISIONAL APPLICATION

This application claims the benefit of provisional application serial no. 60/044,346 filed Apr. 29, 1997.

FIELD OF THE INVENTION

This invention relates to subsea connections between a subsea wellhead and a Christmas tree, and particularly to the apparatus and method for connecting a Christmas tree to a subsea wellhead housing without the use of guidelines.

BACKGROUND OF THE INVENTION

Heretofore, subsea guidance systems for interfacing a Christmas tree to a subsea wellhead have oftentimes included an upwardly facing funnel on the wellhead to guide and receive the lower end portion of the Christmas tree as the Christmas tree is lowered into a vertically aligned position with the subsea wellhead. The subsea wellhead normally includes a high pressure wellhead housing projecting upwardly from a low pressure wellhead housing or bowl.

The conventional vertical Christmas tree has a sturdy or robust connector at its bottom end for connection to a wellhead and can easily withstand vertical impacts associated with the installation of the tree on the wellhead assembly. Such impacts are likely to occur multiple times, because the surface vessel is subject to heaving in response to sea conditions. The tree is also likely to swing laterally in response to lateral movements during the positioning of the tree above the wellhead.

However, a horizontal Christmas tree often has a lower wellhead connector which includes an orientation sleeve projecting downwardly from the tree body for connection to a high pressure wellhead housing extending upwardly from the outer low pressure wellhead housing. The orientation sleeve must be aligned with the projecting high pressure wellhead housing and may be easily damaged if not properly aligned. The projecting orientation sleeve and particularly the lower sealing surface thereof is fragile and vulnerable to damage if not properly aligned, particularly upon improper contact with the projecting low pressure wellhead housing.

The most common technique for protecting the downward projecting orientation sleeve has been to provide a downwardly opening funnel on the tree body around the orientation sleeve for guiding the tree and the orientation sleeve into correct alignment with the wellhead. However, it has been found that damage to the orientation sleeve may occur even if a downwardly opening funnel is provided on the tree about the orientation sleeve, because geometric considerations associated with the greater wellhead system configuration may prevent optimum design for the guidance system. The orientation sleeve when installed typically extends downwardly between the tree body and the production casing hanger which is positioned inside the projecting high pressure wellhead housing and forms a fluid pressure barrier against the production casing hanger. The orientation sleeve is relatively long and may project a distance of about two (2) feet or more below the tree body. The orientation sleeve includes seals and is easily damaged, particularly if lowered onto an upwardly opening funnel on the wellhead.

It is desirable that a system for interfacing a tree and subsea wellhead be provided which does not require utilization of funnels on the wellhead or the tree.

SUMMARY OF THE INVENTION

This invention relates particularly to a method and apparatus for guiding a tree to a subsea wellhead housing with the tree having an orientation sleeve projecting downwardly from the tree body for connection to a high pressure wellhead housing projecting upwardly from an outer low pressure wellhead housing or bowl. For delivering the tree to the wellhead, a tree running tool is mounted within the tree body and extends downwardly within and below the orientation sleeve to provide a lower, possibly flexible end portion or stinger extending downwardly below the orientation sleeve for guiding and aligning the orientation sleeve within the wellhead. The lower end of the running tool has a tapered nose element thereon which initially contacts the upper bore of the projecting high pressure wellhead housing to guide the orientation sleeve downwardly within the upper end of the high pressure wellhead housing.

A production casing hanger is suspended from the high pressure wellhead housing; the lower end of the running tool contacts and rides along the inner peripheral surface of the production casing hanger and suspended casing after being received within the high pressure wellhead housing for accurate lateral positioning of the orientation sleeve. The lower end of the orientation sleeve is received within the production casing hanger and provides a fluid pressure barrier between the tree and the wellhead system which supplements the wellhead housing gasket positioned between the tree and the high pressure wellhead housing.

The method is particularly directed to a horizontal tree having an orientation sleeve extending downwardly from the tree body for initially contacting the projecting high pressure wellhead housing for alignment of the tree with the wellhead. A tree running tool has a lower stabbing extension or stinger with a tapered nose on its lower end which is constructed to be forgiving, so as not to damage the high pressure wellhead housing upon contact therewith and still accurately align the orientation sleeve prior to the orientation sleeve being received within the high pressure wellhead housing and the production casing hanger therein. Upon installation of the orientation sleeve and connection of the tree to the wellhead, the running tool is removed from the tree body.

The tree running tool includes a mechanism for attaching itself onto the tree body typically adjacent the upper end of the body. The tool which embodies the invention may include an intermediate enlarged diameter portion which is constructed to contact the internal bore of the orientation sleeve for the purpose of gaining support.

An object of the present invention is to provide an apparatus and method for connecting a tree to a subsea wellhead without the utilization of any funnels on the tree or on the wellhead housing.

A further object of the invention is the provision of such a method and apparatus for connecting a horizontal tree having an orientation sleeve extending downwardly from the tree body and constructed for being received within an upwardly or downwardly projecting high pressure wellhead housing without damaging the orientation sleeve or the wellhead system.

Another object is the provision of a tree running tool having a lower, possibly flexible end portion extending within and below the orientation sleeve for guiding and accurately aligning the orientation sleeve within the high pressure wellhead housing and production casing hanger.

Other objects, features, and advantages of this invention will be apparent from a review of the following specification and drawings.

BRIEF DESCRIPTION OF THE DRAWINGS

The objects, advantages and features of the invention will become more apparent by reference to the drawings which are appended hereto and wherein an illustrative embodiment of the invention is shown, of which:

FIG. 2 is a generally schematic illustration of a horizontal tree having an orientation sleeve extending downwardly from the tree body and having a downwardly opening funnel on the tree body extending about and below the orientation sleeve for guiding the sleeve onto the upper end of a high pressure wellhead housing which extends a substantial distance above the wellhead bowl, and also showing a "phantom line" depiction of how the downwardly opening funnel would tend to foul the wellhead system components beyond the high pressure wellhead housing if not carefully designed, where designing to avoid this interference could tend to make the downwardly opening funnel less effective at protecting the tree orientation sleeve;

FIG. 3 is an enlarged sectional view showing a tree running tool connected to a tree body with the running tool extending downwardly within and below the orientation sleeve and within the bore of the wellhead system casing hanger for guiding the orientation sleeve into an aligned position with the high pressure wellhead housing of the subsea wellhead.

DESCRIPTION OF THE PRIOR ART

Figure 1A:
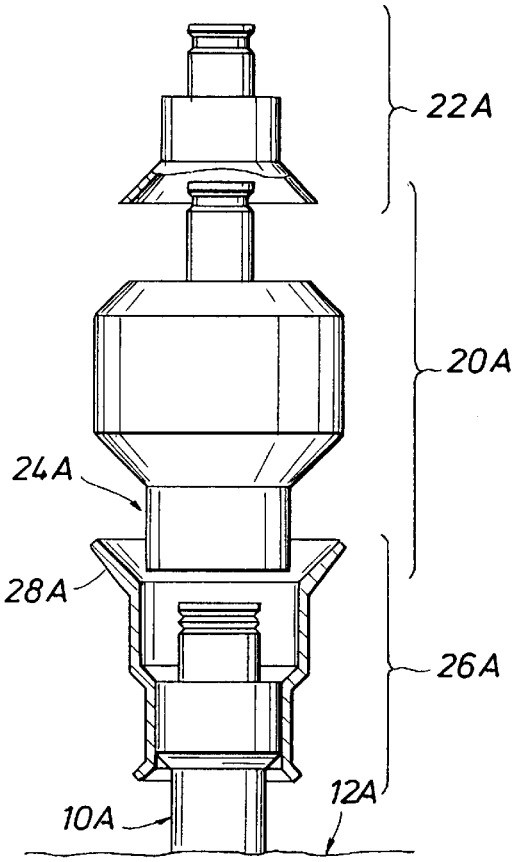
FIG. 1A (PRIOR ART)
FIG. 1A shows a conventional prior art arrangement for guidance of a tree to a subsea wellhead having an upwardly directed funnel for receiving the vertical tree connector.

Prior Art Arrangement of FIG. 1A

FIG. 1A shows a conventional prior art arrangement of guiding hardware deployed from the ocean surface onto a wellhead system or wellhead 10A fixed at the sea bed 12A. Wellhead 10A includes a guide-line-less re-entry assembly 26A having a funnel 28A with its capture cone opening upwardly so that a tree 20A can be lowered thereinto. A conventional vertical tree is shown. A tree cap 22A is disposed above guide-line-less conventional tree 20A. The tree cap 22A is not illustrated as fully landed on tree 20A, and tree 20A is not shown as fully landed on wellhead system 10A and re-entry assembly 26A. The illustration of the components of FIG. 1A in non-fully-landed configuration is presented to clearly show the individual components of a typical full assembly.

The conventional vertical tree 20A has a sturdy or robust tree connector body 24A at its bottom end which can easily withstand the impacts with the funnel 28A associated with the installation of tree 20A to the wellhead re-entry assembly 26A. Such impacts are likely to occur vertically multiple times, because the surface vessel is subject to heaving in response to sea conditions. The vertical tree 20A is also likely to swing laterally in response to lateral movements during the positioning of the guide-line-less tree 20A for landing onto wellhead 10A. A key/slot mechanism (not shown) is provided between the tree connector 24A having pins and funnel 28A having slots in order to ensure repeatable rotational alignment between tree 20A and wellhead 10A.

Figure 1B:
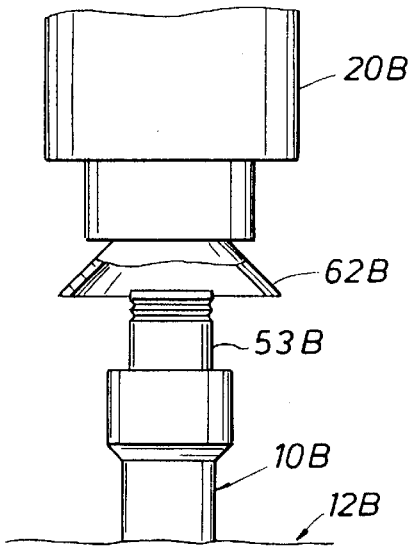
FIG. 1B (PRIOR ART)
FIG. 1B shows a prior art arrangement for guidance of a tree to a subsea wellhead in which a downwardly opening funnel on the tree body extends from the tree for guidance of the tree into lateral alignment with the high pressure wellhead housing.

Prior Art Arrangement of FIG. 1B

FIG. 1B illustrates another prior art arrangement for guiding a guide-line-less Blow-Out Preventer (BOP) stack or Christmas tree for connection to a wellhead, and may be referred to as a "funnel-down" arrangement. Subsea wellhead or wellhead system 10B is fixed to the sea bed 12B. Funnel-down arrangements have been used most often in drilling (rather than completion) activities because with drilling there is typically not a need to rotationally orient the blowout preventer (BOP) stack to the wellhead. With no requirement for rotational orientation, and with the guide "cone" or funnel-down arrangement 62B attached to a BOP stack, there is no requirement for any kind of guidance related structure on the wellhead equipment. Because such guidance related structures are expensive, it is overall less expensive to use funnel down alignment arrangements for BOP stack installation to a subsea wellhead. Funnels for guide-line-less remote interfacing are typically sized to be one and one-half to two times the size of the element intended to be captured by the funnel. Because a "funnel-down" funnel 62B need only capture a high-pressure wellhead housing of typically twenty-six (26) inches to thirty-two (32) inches in diameter, they can be smaller, lighter and cheaper than "funnel-up" funnels 28A which are used to capture both tree and BOP connectors which may be as large as seventy (70) inches in diameter. When it is desired to use funnel-down arrangement 62B on conventional trees, an orientation apparatus must be provided, because it is imperative that these trees be capable of being repeatedly installed in a fixed and known rotational orientation relative to flow lines, tubing hangers, etc. In addition to being more cost effective, the funnel-down system has a smaller "foot-print"; that is, it uses less area or volume within the tree envelope. Because horizontal trees are interfaced from above by BOP stacks, the smaller "funnel footprint" facilitates positioning of modules such as chokes, flow meters, flowline interface equipment, etc.

Figure 1C:
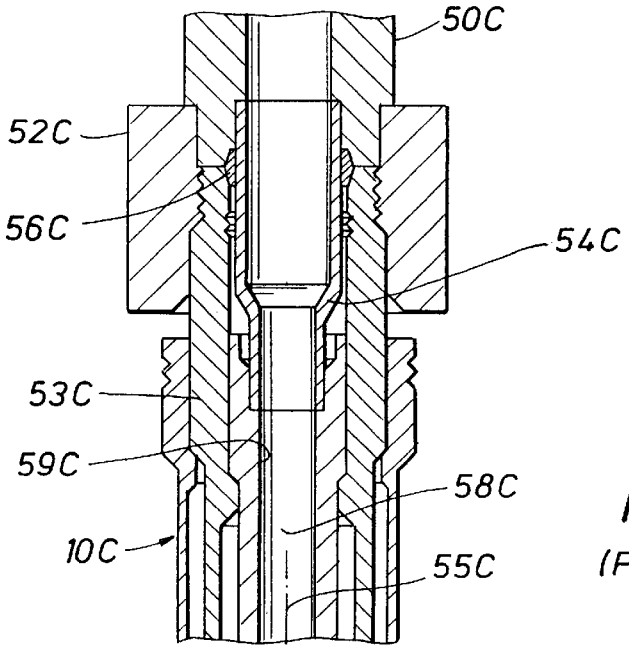
FIG. 1C (PRIOR ART)
FIG. 1C is an enlarged cross sectional view of a horizontal tree connected to a wellhead and having an orientation sleeve extending downwardly from the tree body and received within a high pressure wellhead housing and casing hanger disposed therein for providing a pressure barrier between the tree and wellhead.

Prior Art Arrangement of FIG. 1C

FIG. 1C shows a partial cross section view of a horizontal tree body 50C landed on a wellhead system 10C on the sea bed. A horizontal tree connector 52C connects body 50C of the tree to a high pressure wellhead housing 53C. An orientation sleeve 54C extends downwardly between the tree body 50C and the bore 58C of the production casing hanger and casing 59C located inside the wellhead housing 53C. Bore 58C has a centerline at 55C. The orientation sleeve 54C may both orient a tubing hanger (not shown) relative to the tree body 50C and provide a pressure barrier which is redundant to the wellhead housing gasket 56C. In order to achieve its functions, the orientation sleeve 54C is typically relatively long and protrudes a distance of about two feet below the bottom of the tree connector 52C in most instances. Orientation sleeve 54C is also delicate and relatively fragile by comparison to tree connector 52C, because of its seals and other exposed components. A likelihood of damage to orientation sleeve 54C exists if the arrangement of FIG. 1C is lowered onto a funnel such as shown at 28A in FIG. 1A.

DESCRIPTION OF THE INVENTION

The present invention is particularly adapted for use with horizontal Christmas trees in which production and annulus valves are arranged external to the tree main vertical bore. Normally, the orientation sleeve extends downwardly from the horizontal tree body, and it is necessary to guide and protect the orientation sleeve during the installation or connection of the tree body to the wellhead.

Embodiment of FIG. 2

FIG. 2 illustrates an embodiment of the invention which is adapted for use with a downwardly opening funnel or "funnel-down" arrangement on the tree connector body 50 in combination with the high pressure wellhead housing 53 projecting upwardly from a low pressure wellhead housing or bowl 10 fixed to the seabed 12. Orientation sleeve 54 is of a relatively long length, typically extending about 2 feet below tree connector body 50. In order to adequately protect orientation sleeve 54 as it approaches the top of high pressure housing 53, funnel 70 must be so long that it typically interferes with low pressure housing 10 at some point during the tree landing process. Interference is shown in a phantom line depiction of funnel 70 in FIG. 2. To avoid this problem the high pressure housing 53 could be lengthened or one of the offending components could be made to be "extendable" and/or "retractable". Funnel 70 or an associated device integrated as part of the wellhead system against which funnel 70 could react would be likely candidates for the latter approach, with the orientation sleeve 54 being a less likely candidate.

Figure 4:
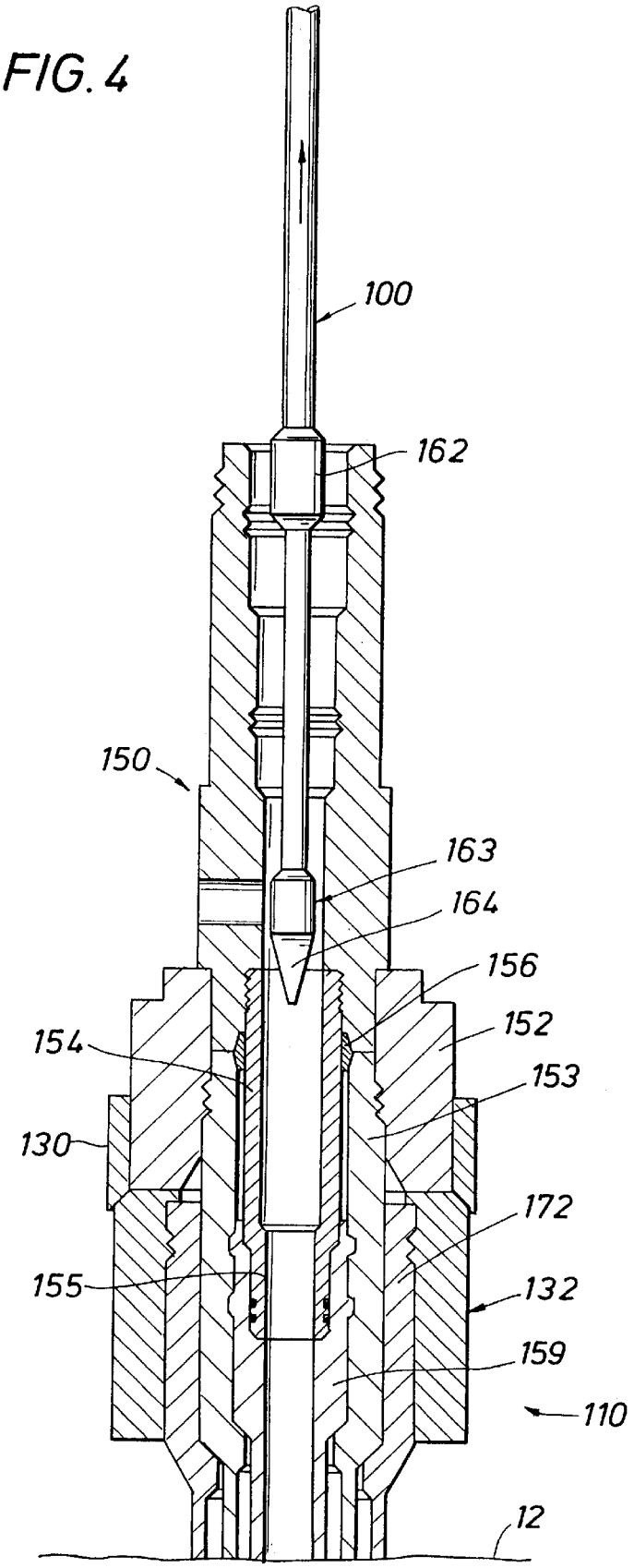
FIG. 4 is a sectional view similar to FIG. 3 but showing the tree connected to the wellhead, the orientation sleeve providing a fluid pressure barrier between the tree and the wellhead, and showing the running tool being retrieved from the bore of the wellhead housing and tree.

Preferred Embodiment of the Invention Illustrated In FIGS. 3 and 4

The embodiment shown in FIGS. 3 and 4 provides a tree running tool generally indicated at 120 having a lower alignment stab member or stinger generally indicated at 100. Running tool 120 is adapted for mounting within horizontal tree or tree body generally indicated at 150 which has an orientation sleeve 154 secured to body 150 and extends downwardly therefrom. Tree body 150 carries a wellhead housing gasket 156 which forms the primary pressure seal between the tree body 150 and the high pressure wellhead housing 153 when the connection between the wellhead and tree is completed. A tree connector 152 may have an outer ring or similar element 130 secured thereon.

Wellhead or wellhead system 110 mounted on sea bed 112 has a low pressure wellhead housing or bowl 172 and a high pressure wellhead housing 153 projecting upwardly from low pressure wellhead housing 172. A lower ring or similar element 132 about wellhead housing 172 is adapted for interfacing with upper ring or similar element 130 to ensure repeatable alignment between wellhead system 110 and tree 150 when connected, if desired. A casing hanger and casing 159 are suspended from high pressure wellhead housing 153. The centerline of the production bore is shown at 158 which is the same as the longitudinal axis of running tool 120.

Running tool 120 has an upper enlarged diameter portion 160 which contains a mechanism for releasably securing the tool 120 to the tree body 150. The lower alignment stab member or stinger 100 extends downwardly from tool portion 160. An intermediate enlarged diameter stinger portion 162 may be provided to contact the bore of orientation sleeve 154 as shown at 155 for stabilizing stinger 100. The lower end of stinger 100 has a nose element 163 for contacting the inner peripheral surface of casing hanger/casing 159. The lower end of nose 163 is tapered at 164 and is adapted for contacting high pressure wellhead housing 153 and casing hanger/casing 159 to facilitate accurate alignment for the orientation sleeve 154. The alignment stab extension or stinger 100 with nose 163 extends through the bore of tree body 150 so that nose 163 can be stabbed into the bore of the well production casing hanger/casing 159. The non-damaging and smoothly profiled nose element 163 protects critical surfaces on and in the high pressure wellhead housing 153 and production casing hanger 159. The diameter of the nose 163 is constructed to pass into the bore of the production casing 159, and thus provide a large capture ratio relative to the upper bore of the wellhead housing 153 (greater than two to one). The taper 164 of nose 163 improves this ratio further. Of course, the diameter of nose 163 and/or other characteristics may be modified, as appropriate. Since stinger 100 is integrated with the tree running tool 120, it is retrievable and is reusable. Because stinger 100 will effectively centralize the horizontal tree 150 over the wellhead 110, a funnel arrangement is not required for either the tree 150 or the wellhead 110. If the stinger 100 is sufficiently long and/or flexible it may be practical for a remotely operated vehicle (ROV) to assist in positioning of the alignment stab extension or stinger 100 relative to the wellhead housing 153.

FIGS. 3 and 4 illustrate rotational alignment members 130, 132 connected respectively to horizontal tree connector 152 and to the low pressure housing 172 of wellhead system 110. The purpose of these or similar members is to ensure repeatable rotational alignment of horizontal tree 150 and wellhead system 110. Typically a preferred orientation for the system is established by setting and locking the position of member 132 (using an ROV or surface deployed tool) so that member 130 can be subsequently interfaced thereto upon landing of tree 150. It is also an option that members 130 and 132 can be interfaced as part of the tree landing operation. In this scenario members 130 and 132 are first interfaced and locked together. Next, the tree 150 and interlocked members 130 and 132 are oriented relative to the wellhead system 110. Then, the tree 150 is fully landed and locked. Finally, ring member 132 is fixed to low pressure housing 172 in a follow-up operation. Thereafter, member 130 causes the horizontal tree 150 to be landed in correct alignment with the now "fixed" member 132 on wellhead 110.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A method of connecting a tree (150) to a subsea wellhead housing utilizing a running tool (120) for guiding the tree downwardly into an aligned position with the subsea wellhead housing for connection of the tree to the wellhead housing, the tree having a body and a bore extending through said body; said method comprising the steps of:

mounting a lower orientation sleeve (154) to said tree so that it extends a substantial distance downwardly from the tree body and in axial alignment with the tree bore;

mounting the running tool (120) within said tree body and orientation sleeve (154) with a lower end portion (163) of the tool (100) extending downwardly below said sleeve to provide a lower stabbing extension for guiding and aligning the orientation sleeve within said wellhead housing; and lowering said running tool (120) with said tree (150) thereon downwardly onto said wellhead housing (153), the lower end of the running tool extending through an upper end of the wellhead housing to guide the orientation sleeve downwardly for accurate alignment within the wellhead housing.

2. The method of claim 1 further including the steps of:

providing a tapered nose on the lower end of said end portion for initially contacting the upper bore of said wellhead housing to guide the orientation sleeve into position for connection of the tree body to the wellhead housing;

connecting said tree body to the wellhead housing; and removing said tool from said tree body.

3. The method of claim 1 including the steps of:

providing said orientation sleeve (154) with a bore against which said running tool (120) may contact to gain alignment and support; and disposing said running tool within said bore of said orientation sleeve.

4. A method of connecting a horizontal tree (150) to a subsea wellhead (110) utilizing a running tool (120) for guiding the horizontal tree downwardly into an aligned position with the subsea wellhead for connection of the horizontal tree to the subsea wellhead, the subsea wellhead having an upwardly projecting high pressure wellhead housing (153) and a production casing hanger (159) supported within the high pressure wellhead housing, the horizontal tree having a body and an axial bore extending through said body; said method comprising the steps of:

providing a lower orientation sleeve (154) with said horizontal tree to extend a substantial distance downwardly from the tree body, said orientation sleeve arranged and designed for axial alignment with the axial bore;

mounting the running tool (120) within said tree body and orientation sleeve with a lower end portion (163) of the tool (100) extending downwardly below said orientation sleeve to provide a lower stabbing extension for guiding and aligning the orientation sleeve with said high pressure wellhead housing and said production casing hanger (159); and lowering said running tool (120) with said tree (150) thereon downwardly onto said high pressure wellhead housing (153) and said production casing hanger (159), the lower end of the running tool having a lower end (164) arranged and designed for contacting the upper end of high pressure wellhead housing to guide the orientation sleeve (154) downwardly for accurate alignment with the high pressure wellhead housing (153) and production casing hanger(159).

5. The method of claim 4 including the step of:

providing a tapered nose on the lower end of said end portion for initially contacting the upper end of said high pressure wellhead housing to guide the orientation sleeve into position for connection of the tree body to the high pressure wellhead housing.

6. The method of claim 4 further including the steps of:

providing said orientation sleeve (154) with a bore against which said running tool (120) may contact to gain alignment and support; and disposing said running tool within said bore of said orientation sleeve.

7. A tree running tool (120) for mounting within the tree body (150) of a horizontal tree for connection of the horizontal tree to a subsea wellhead (110), the subsea wellhead having a high pressure wellhead housing (153) projecting upwardly from a low pressure wellhead housing (172) and a production casing hanger (159) supported within the high pressure wellhead housing; the tree body having an orientation sleeve (154) projecting downwardly from the tree body for mounting within the high pressure wellhead housing (153) to provide a fluid pressure barrier with said production casing hanger (159); said tool comprising:

a mounting member (160) for connection of said tool to said tree body; and a stinger (100) extending downwardly from said mounting member having an intermediate portion(162) in contact with said orientation sleeve when said running tool (120) is connected to said tree (150) and a lower tapered nose (164) at the lower end of said stinger (100) to engage the high pressure wellhead housing (153) and production casing hanger/casing (159) for alignment of the orientation sleeve (154) with the high pressure wellhead housing (153) and production casing hanger (159).

8. The tree running tool (120) of claim 7 wherein said stinger (100) is flexible.

9. The tree running tool of claim 7 wherein said lower tapered nose includes an enlarged diameter end portion (163) having a tapered end (164).

10. The running tool of claim 7 wherein said stinger includes an enlarged diameter portion (162) which engages said orientation sleeve.

* * * * *